US007614849B2

(12) United States Patent
Schmitz et al.

(10) Patent No.: US 7,614,849 B2
(45) Date of Patent: Nov. 10, 2009

(54) USE OF A THERMAL BARRIER COATING FOR A HOUSING OF A STEAM TURBINE, AND A STEAM TURBINE

(75) Inventors: Friedhelm Schmitz, Dinslaken (DE); Kai Wieghardt, Bochum (DE)

(73) Assignee: Siemens Aktiengesellschaft, Munich (DE)

( * ) Notice: Subject to any disclaimer, the term of this patent is extended or adjusted under 35 U.S.C. 154(b) by 436 days.

(21) Appl. No.: 10/582,598

(22) PCT Filed: Dec. 1, 2004

(86) PCT No.: PCT/EP2004/013651

§ 371 (c)(1),
(2), (4) Date: Jun. 9, 2006

(87) PCT Pub. No.: WO2005/056985

PCT Pub. Date: Jun. 23, 2005

(65) Prior Publication Data

US 2007/0140840 A1 Jun. 21, 2007

(30) Foreign Application Priority Data

Dec. 11, 2003 (EP) ..... 03028575

(51) Int. Cl.
*F04D 29/02* (2006.01)
*F01D 5/28* (2006.01)

(52) U.S. Cl. ..... 415/200; 415/217.1

(58) Field of Classification Search ..... 415/108, 415/200, 220, 217.1
See application file for complete search history.

(56) References Cited

U.S. PATENT DOCUMENTS

| | | | | |
|---|---|---|---|---|
| 4,405,284 | A | 9/1983 | Albrecht et al. | |
| 5,350,599 | A | 9/1994 | Rigney et al. | |
| 5,645,399 | A | 7/1997 | Angus | |
| 5,740,515 | A | 4/1998 | Beele | |
| 6,336,789 | B1 | 1/2002 | Beerens et al. | |
| 6,345,953 | B1 | 2/2002 | Henkel et al. | |
| 6,755,613 | B1 * | 6/2004 | Schmitz | 415/200 |
| 2003/0152814 | A1 | 8/2003 | Gupta et al. | |

FOREIGN PATENT DOCUMENTS

| | | |
|---|---|---|
| DE | 723476 | 8/1942 |
| DE | 195 35 227 A1 | 3/1997 |
| EP | 0 374 603 A1 | 6/1990 |
| EP | 0 783 043 | 7/1997 |
| EP | 1 029 115 B1 | 9/2001 |
| GB | 1 556 274 | 11/1979 |
| WO | WO 00/25005 | 5/2000 |

* cited by examiner

*Primary Examiner*—Edward Look
*Assistant Examiner*—Dwayne J White

(57) ABSTRACT

The invention relates to the use of a thermal insulating layer for a housing of a steam turbine in order to even out the deformation behavior of different components based on different heatings of the components.

12 Claims, 9 Drawing Sheets

USE OF A THERMAL BARRIER COATING FOR A HOUSING OF A STEAM TURBINE, AND A STEAM TURBINE

CROSS REFERENCE TO RELATED APPLICATIONS

This application is the US National Stage of International Application No. PCT/EP2004/013651, filed Dec. 1, 2004 and claims the benefit thereof. The International Application claims the benefits of European Patent application No. 03028575.3 filed Dec. 11, 2003. All of the applications are incorporated by reference herein in their entirety.

FIELD OF THE INVENTION

The invention relates to the use of a thermal barrier coating and to a steam turbine.

BACKGROUND OF THE INVENTION

Thermal barrier coatings which are applied to components are known from the field of gas turbines, as described for example in EP 1 029 115 or WO 00/25005.

It is known from DE 195 35 227 A1 to provide a thermal barrier coating in a steam turbine in order to allow the use of materials which have worse mechanical properties but are less expensive for the substrate to which the thermal barrier coating is applied. The thermal barrier coating is applied in the cooler region of a steam inflow region.

GB 1 556 274 discloses a turbine disk having a thermal barrier coating in order to reduce the introduction of heat into the thinner regions of the turbine disk.

U.S. Pat. No. 4,405,284 discloses a two-layer ceramic outer layer for improving the abrasion properties.

U.S. Pat. No. 5,645,399 discloses the local application of a thermal barrier coating in a gas turbine in order to reduce the axial clearances.

Patent specification 723 476 discloses a housing which is of two-part design and has an outer ceramic layer which is thick. The housing parts of the one housing are arranged above one another but not axially next to one another.

Thermal barrier coatings allow components to be used at higher temperatures than the base material alone permits or allow the service life to be extended.

Known base materials allow use temperatures of at most 1000° C.-1100° C., whereas a coating with a thermal barrier coating allows use temperatures of up to 1350° C. in gas turbines.

The temperatures of use of components of a steam turbine are considerably lower than in gas turbines, but the pressure and density of the fluid are higher and the type of fluid is different, which means that in steam turbines different demands are imposed on the materials.

The radial and axial clearances between rotor and stator are essential to the efficiency of a steam turbine. The deformation of the steam turbine housing has a crucial influence on this; its function is, inter alia, to position the guide vanes with respect to the rotor blades secured to the shaft. These housing deformations include thermal elements (caused by the introduction of heat) and visco-plastic elements (caused by component creep and/or relaxation).

For other components of a steam turbine (e.g. valve housings), inadmissible visco-plastic deformations have a disadvantageous influence on their function (e.g. leak tightness of the valve).

SUMMARY OF THE INVENTION

It is an object of the invention to overcome the abovementioned problems.

The object is achieved by the use of a thermal barrier coating for a housing for a steam turbine as claimed in the claims.

The object is also achieved by the steam turbine as claimed in the claims, which has a thermal barrier coating with locally different parameters (materials, porosity, thickness). The term locally means regions of the surfaces of one or more components of a turbine which are positionally demarcated from one another.

The thermal barrier coating is not necessarily used only to shift the range of use temperatures upward, but also to have a controlled positive influence on the deformation properties by a) lowering the integral steady-state temperature of a housing part compared to another housing part,
b) shielding the components from steam with greatly variable temperatures during non-steady states (starting, running down, load change),
c) reducing the visco-plastic deformations of housings which occur both as a result of decreasing creep resistance of the materials at high temperatures and as a result of thermal stresses caused by temperature differences in the component.

The subclaims list further advantageous configurations of the component according to the invention.

The measures listed in the subclaims can be combined with one another in advantageous ways.

The controlled influencing of the deformation properties have a favorable effect if there is a radial gap between turbine rotor and turbine stator, i.e. turbine blade or vane and a housing, by minimizing this radial gap.

Minimizing the radial gap leads to an increase in the turbine efficiency.

The controlled deformation properties are also advantageously used to set axial gaps in a steam turbine, in particular between rotor and housing, in a controlled way.

Particularly advantageous effects are achieved by an integral temperature of the housing being lower, as a result of the application of the thermal barrier coating, than the temperature of the shaft, so that the radial gap between rotor and stator, i.e. between the tip of the rotor blade and the housing or between the tip of the guide vane and the shaft, is smaller in operation (higher temperatures than room temperature) than during assembly (room temperature). A reduction in the non-steady-state thermal deformation of housings and the matching thereof to the deformation properties of the generally more thermally inert turbine shaft likewise reduces the radial clearances which have to be provided. The application of a thermal barrier coating also reduces viscous creep deformation and the component can be used for longer.

The thermal barrier coating can advantageously be used for newly produced components, used components (i.e. no repair required) and refurbished components.

BRIEF DESCRIPTION OF THE DRAWINGS

Exemplary embodiments are illustrated in the figures, in which.

DETAILED DESCRIPTION OF THE INVENTION

Figure 1:
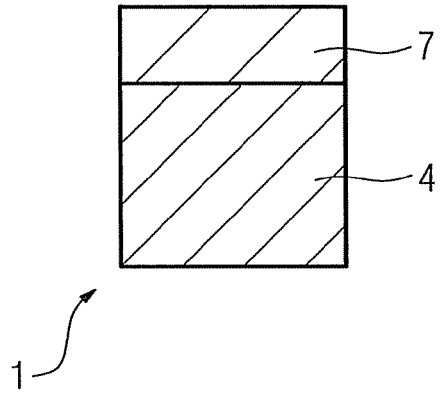
FIGS. 1, 2, 3, 4 show possible arrangements of a thermal barrier coating of a component.

FIG. 1 shows a first exemplary embodiment of a component 1 for the use according to the invention. The component 1 is a component or housing, in particular a housing 335 of an inflow region 333 of a turbine (gas, steam), in particular of a steam turbine 300, 303 (FIG. 8), and comprises a substrate 4 (e.g. bearing structure) and a thermal barrier coating 7 applied to it.

The thermal barrier coating 7 is in particular a ceramic layer which consists, for example, of zirconium oxide (partially stabilized, fully stabilized by yttrium oxide and/or magnesium oxide) and/or of titanium oxide, and is, for example, thicker than 0.1 mm. It is in this way possible to use thermal barrier coatings 7 which consist 100% of either zirconium oxide or titanium oxide. The ceramic layer can be applied by means of known coating processes, such as atmospheric plasma spraying (APS), vacuum plasma spraying (VPS), low-pressure plasma spraying (LPPS), as well as by chemical or physical coating methods (CVD, PVD).

Figure 2:
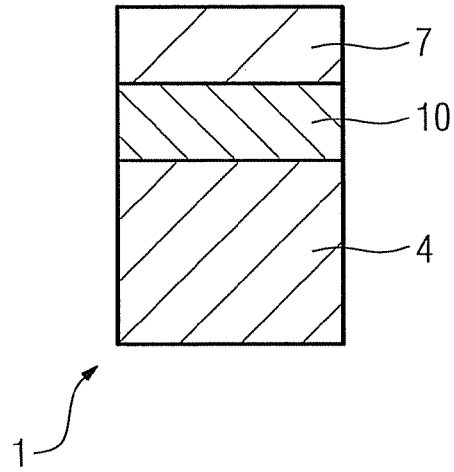

FIG. 2 shows a further configuration of the component 1 for the use according to the invention. At least one intermediate protective layer 10 is arranged between the substrate 4 and the thermal barrier coating 7.

The intermediate protective layer 10 is used to protect the substrate 4 from corrosion and/or oxidation and/or to improve the bonding of the thermal barrier coating to the substrate 4. This is the case in particular if the thermal barrier coating consists of ceramic and the substrate 4 consists of a metal.

The intermediate protective layer 10 for protecting a substrate 4 from corrosion and oxidation at a high temperature includes, for example, substantially the following elements (details of the contents in percent by weight):

11.5 to 20.0 wt % chromium,
0.3 to 1.5 wt % silicon,
0 to 1.0 wt % aluminum,
0 to 0.7 wt % yttrium and/or at least one equivalent metal selected from the group consisting of scandium and the rare earth elements, remainder iron, cobalt and/or nickel as well as manufacturing-related impurities;

in particular the metallic intermediate protective layer 10 consists of 12.5 to 14.0 wt % chromium,
0.5 to 1.0 wt % silicon,
0 to 0.5 wt % aluminum,
to 0.7 wt % yttrium and/or at least one equivalent metal selected from the group consisting of scandium and the rare earth elements, remainder iron and/or cobalt and/or nickel as well as manufacturing-related impurities.

It is preferable if the remainder is iron alone.

The composition of the intermediate protective layer 7 based on iron has particularly good properties, with the result that the protective layer 7 is eminently suitable for application to ferritic substrates 4. The coefficients of thermal expansion of substrate 4 and intermediate protective layer 10 can be very well matched to one another or may even be identical, so that no thermally induced stresses are built up between substrate 4 and intermediate protective layer 10 (thermal mismatch), which could cause the intermediate protective layer 10 to flake off. This is particularly important since in the case of ferritic materials, it is often the case that there is no heat treatment carried out for diffusion bonding, but rather the protective layer 7 is bonded to the substrate 4 mostly or solely through adhesion.

In particular, the substrate 4 is then a ferritic base alloy, in particular a steel or a nickel-base or cobalt-base superalloy, in particular a 1% CrMoV steel or a 10 to 12 percent chromium steel.

Further advantageous ferritic substrates 4 of the component 1 consist of a 1% to 2% Cr steel for shafts (309, FIG. 4):
such as for example 30CrMoNiV5-11 or 23CrMoNiWV8-8, 1% to 2% Cr steel for housings (for example 335, FIG. 4):
G17CrMoV5-10 or G17CrMo9-10, 10% Cr steel for shafts (309, FIG. 4):
X12CrMoWVNbN10-1-1, 10% Cr steel for housings (for example 335, FIG. 4):
GX12CrMoWVNbN10-1-1 or GX12CrMoVNbN9-1.

Figure 3:
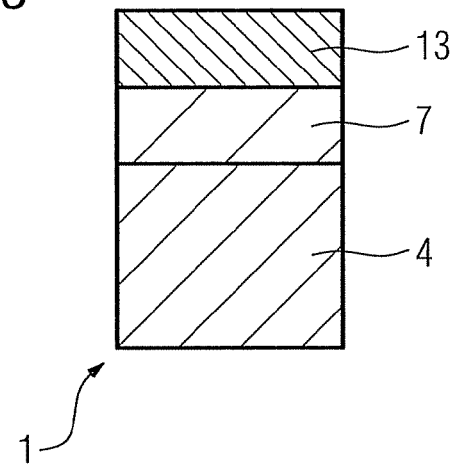

FIG. 3 shows a further exemplary embodiment of the component 1 for the use according to the invention.

An erosion-resistant layer 13 now forms the outer surface on the thermal barrier coating 7.

This erosion-resistant layer 13 consists in particular of a metal or a metal alloy and protects the component 1 from erosion and/or wear, as is the case in particular in steam turbines 300, 303 (FIG. 8) which have scaling in the hot steam region; in this application mean flow velocities of approximately 50 m/s (i.e. 20-100 m/s) and pressures of up to 400 bar occur.

To optimize the efficiency of the thermal barrier coating 7, the thermal barrier coating 7 has a certain open and/or closed porosity.

It is preferable for the wear/erosion-resistant layer 13 to have a higher density and to consist of alloys based on iron, chromium, nickel and/or cobalt or MCrAlX or, for example, NiCr 80/20 or with admixtures of boron (B) and silicon (Si) NiCrSiB or NiAl (for example Ni: 95%, Al 5%).

In particular, it is possible to use a metallic erosion-resistant layer 13 in steam turbines 300, 303, since the temperatures of use in steam turbines 300, 303 at the steam inflow region 33 are at most 800° C. or 850° C. For temperature ranges of this nature, there are enough metallic layers which offer sufficient protection against erosion as required over the duration of use of the component 1.

Metallic erosion-resistant layers 13 in gas turbines on a ceramic thermal barrier coating 7 are not possible everywhere, since metallic erosion-resistant layers 13 as an outer layer are unable to withstand the maximum temperatures of use of up to 1350° C.

Ceramic erosion-resistant layers 13 are also conceivable.

Further examples of material for the erosion-resistant layer 13 include chromium carbide ($Cr_3C_2$), a mixture of tungsten carbide, chromium carbide and nickel (WC—CrC—Ni), for example in proportions of 73 wt % tungsten carbide, 20 wt % chromium carbide and 7 wt % nickel, and also chromium carbide with an admixture of nickel ($Cr_3C_2$—Ni), for example in proportions of 83 wt % chromium carbide and 17 wt % nickel, as well as a mixture of chromium carbide and nickel-chromium ($Cr_3C_2$—NiCr), for example in proportions of 75 wt % chromium carbide and 25 wt % nickel-chromium, and also yttrium-stabilized zirconium oxide, for example in proportions of 80 wt % zirconium oxide and 20 wt % yttrium oxide.

Figure 4:
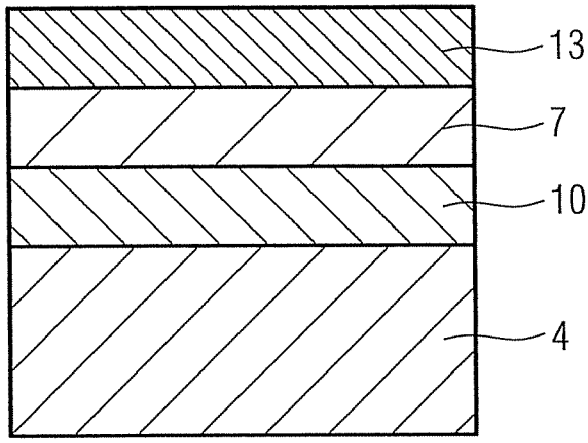

It is also possible for an intermediate protective layer 10 to be present as an additional layer compared to the exemplary embodiment shown in FIG. 3 (as illustrated in FIG. 4).

Figure 5:
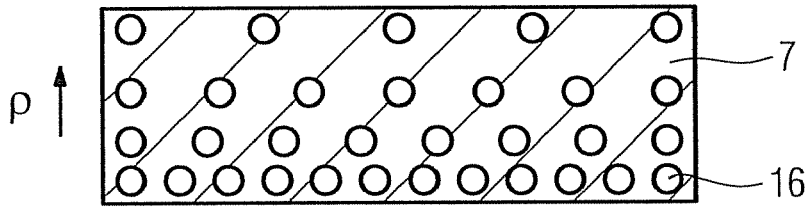
FIGS. 5, 6 show a gradient of the porosity within the thermal barrier coating of a component.

FIG. 5 shows a thermal barrier coating 7 with a porosity gradient.

Pores 16 are present in the thermal barrier coating 7. The density ρ of the thermal barrier coating 7 increases in the direction of an outer surface (the direction indicated by the arrow).

Therefore, there is preferably a greater porosity toward the substrate 4 or an intermediate protective layer 10 which may be present than in the region of an outer surface or the contact surface with the erosion-resistant layer 13.

Figure 6:
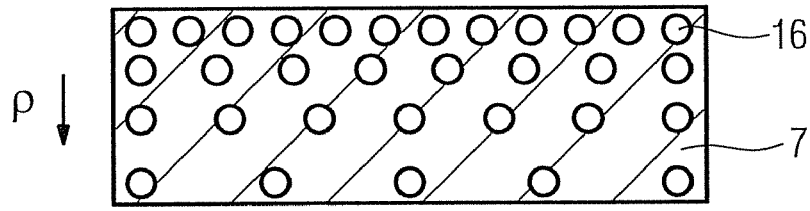

In FIG. 6, the gradient in the density ρ of the thermal barrier coating 7 is opposite to that shown in FIG. 5 (as indicated by the direction of the arrow).

Figure 7A:
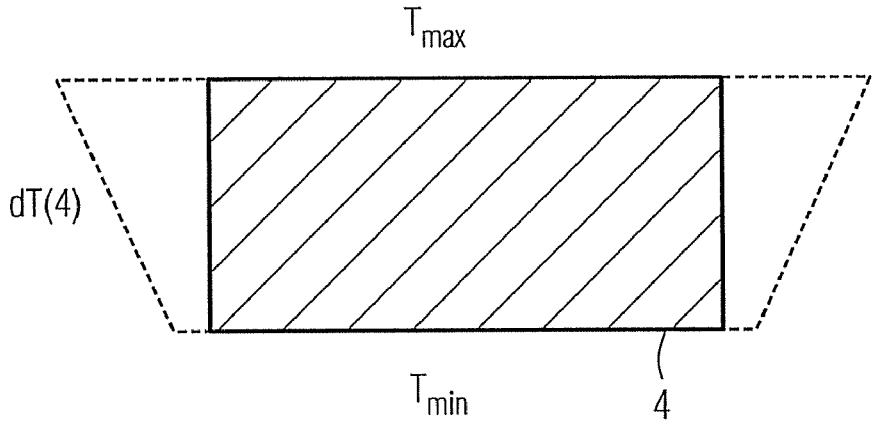
FIGS. 7, 9 show the influence of a temperature difference on a component.

FIGS. 7*a, b* show the influence of the thermal barrier coating 7 on the thermally induced formation properties of the component 1.

FIG. 7*a* shows a component without thermal barrier coating.

Two different temperatures prevail on two opposite sides of the substrate 4, a higher temperature $T_{max}$ and a lower temperature $T_{min}$, resulting in a radial temperature difference dT(4). Therefore, as indicated by dashed lines, the substrate 4 expands to a much greater extent in the region of the higher temperature $T_{max}$ on account of thermal expansion than in the region of the lower temperature $T_{min}$. This different expansion causes undesirable deformation of a housing.

Figure 7B:
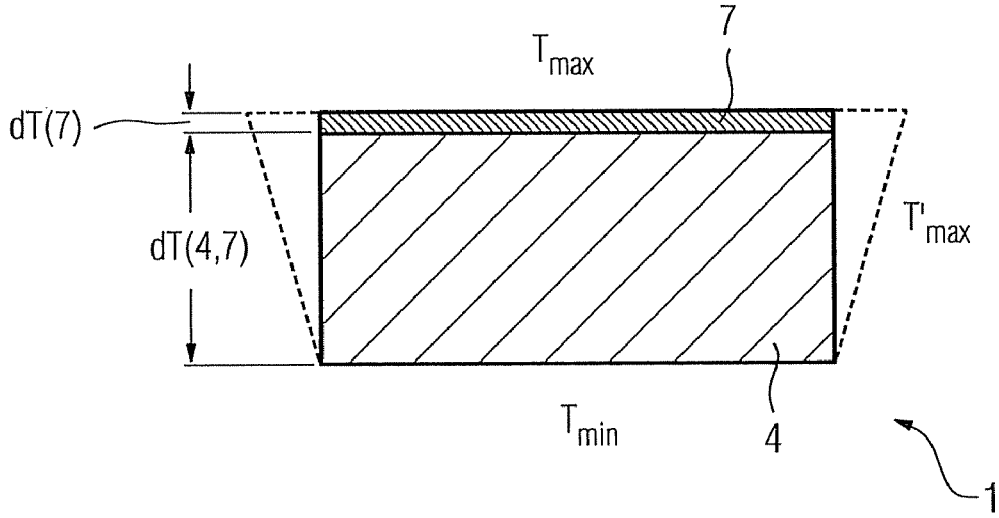

By contrast, in FIG. 7*b* a thermal barrier coating 7 is present on the substrate 4, the substrate 4 and the thermal barrier coating 7 together by way of example being of equal thickness to the substrate 4 shown in FIG. 7*a*.

The thermal barrier coating 7 reduces the maximum temperature at the surface of the substrate 4 disproportionately to a temperature $T'_{max}$, even though the outer temperature $T_{max}$ is just the same as in FIG. 7*a*. This results not only from the distance between the surface of the substrate 4 and the outer surface of the thermal barrier coating 7 which is at the higher temperature but also in particular from the lower thermal conductivity of the thermal barrier coating 7. The temperature gradient is very much greater within the thermal barrier coating 7 than in the metallic substrate 4.

As a result, the temperature difference dT(4,7) ($=T'_{max}-T_{min}$) comes to be lower than the temperature difference in accordance with FIG. 7*a* (dT(4)=dT(7)+dT(4, 7)). This results in the thermal expansion of the substrate 4 being much less different or even scarcely different at all than the surface at the temperature $T_{min}$, as indicated by dashed lines, so that locally different expansions are at least made more uniform. The thermal barrier coatings 7 often also have a lower coefficient of thermal expansion than the substrate 4. The substrate 4 in FIG. 7*b* can also be of exactly the same thickness as that shown in FIG. 7*a*.

Figure 8:
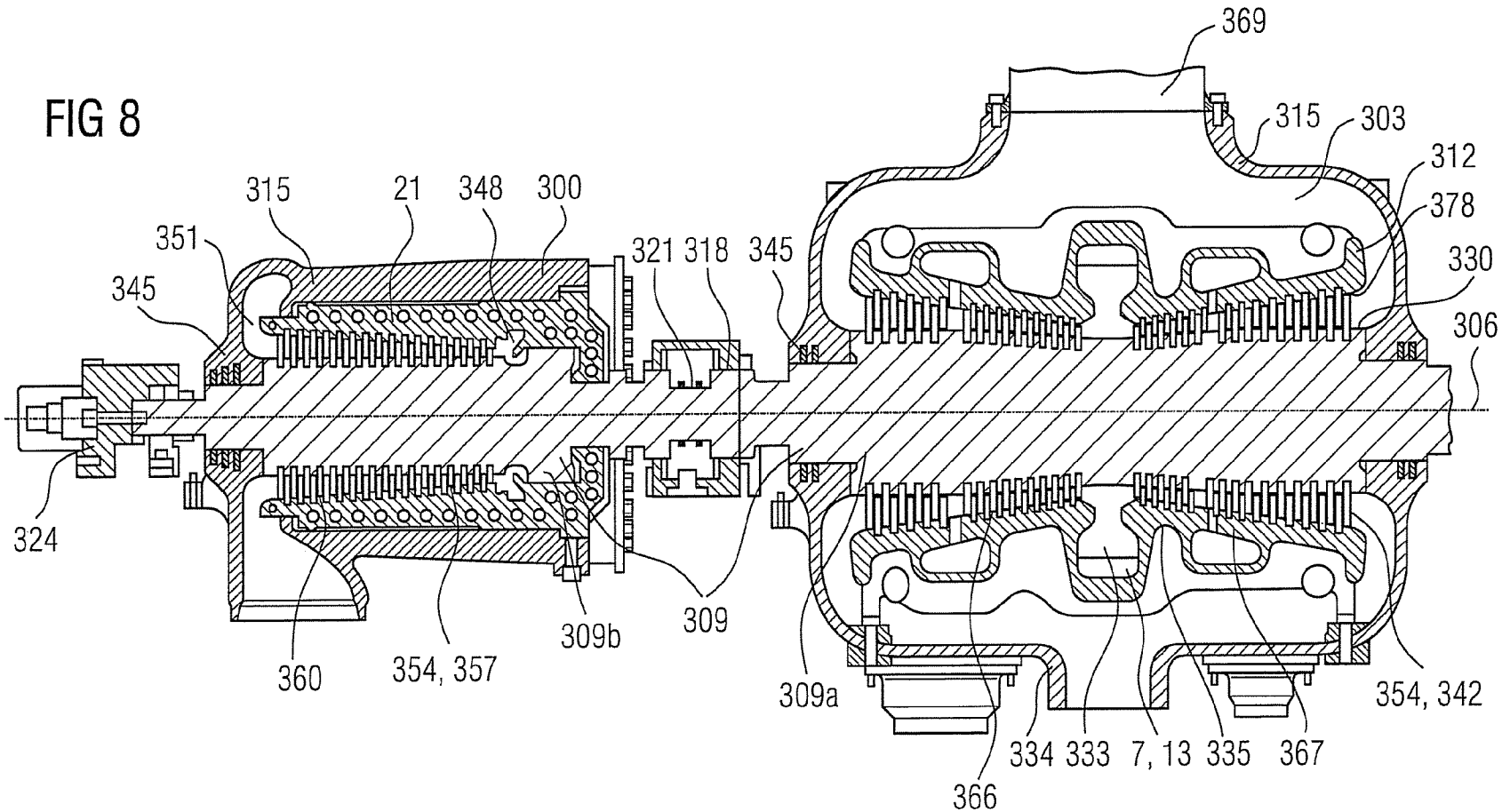
FIG. 8 shows a steam turbine.

FIG. 8 illustrates, by way of example, a steam turbine 300, 303 with a turbine shaft 309 extending along an axis of rotation 306.

The steam turbine has a high-pressure part-turbine 300 and an intermediate-pressure part-turbine 303, each having an inner housing 312 and an outer housing 315 surrounding the inner housing. The medium-pressure part-turbine 303 is of two-flow design. It is also possible for the intermediate-pressure part-turbine 303 to be of single-flow design.

Along the axis of rotation 306, a bearing 318 is arranged between the high-pressure part-turbine 300 and the intermediate-pressure part-turbine 303, the turbine shaft 309 having a bearing region 321 in the bearing 318. The turbine shaft 309 is mounted on a further bearing 324 next to the high-pressure part-turbine 300. In the region of this bearing 324, the high-pressure part-turbine 300 has a shaft seal 345. The turbine shaft 309 is sealed with respect to the outer casing 315 of the intermediate-pressure part-turbine 303 by two further shaft seals 345.

Between a high-pressure steam inflow region 348 and a steam outlet region 351, the turbine shaft 309 in the high-pressure part-turbine 300 has the high-pressure rotor blading 354, 357. This high-pressure rotor blading 354, 357, together with the associated rotor blades (not shown in more detail), constitutes a first blading region 360.

The intermediate-pressure part-turbine 303 has a central steam inflow region 333 with the inner housing 335 and the outer housing 334. Assigned to the steam inflow region 333, the turbine shaft 309 has a radially symmetrical shaft shield 363, a cover plate, on the one hand for dividing the flow of steam between the two flows of the intermediate-pressure part-turbine 303 and also for preventing direct contact between the hot steam and the turbine shaft 309.

In the intermediate-pressure part-turbine 303, the turbine shaft 309 has a second region in housings 366, 367 of the blading regions having the intermediate-pressure rotor blades 354, 342. The hot steam flowing through the second blading region flows out of the intermediate-pressure part-turbine 303 from an outflow connection piece 369 to a low-pressure part-turbine (not shown) which is connected downstream in terms of flow.

The turbine shaft 309 is composed of two turbine part-shafts 309*a* and 309*b*, which are fixedly connected to one another in the region of the bearing 318.

In particular, the steam inflow region 333 of any steam turbine type has a thermal barrier coating 7 and/or an erosion-resistant layer 13.

Figure 16:
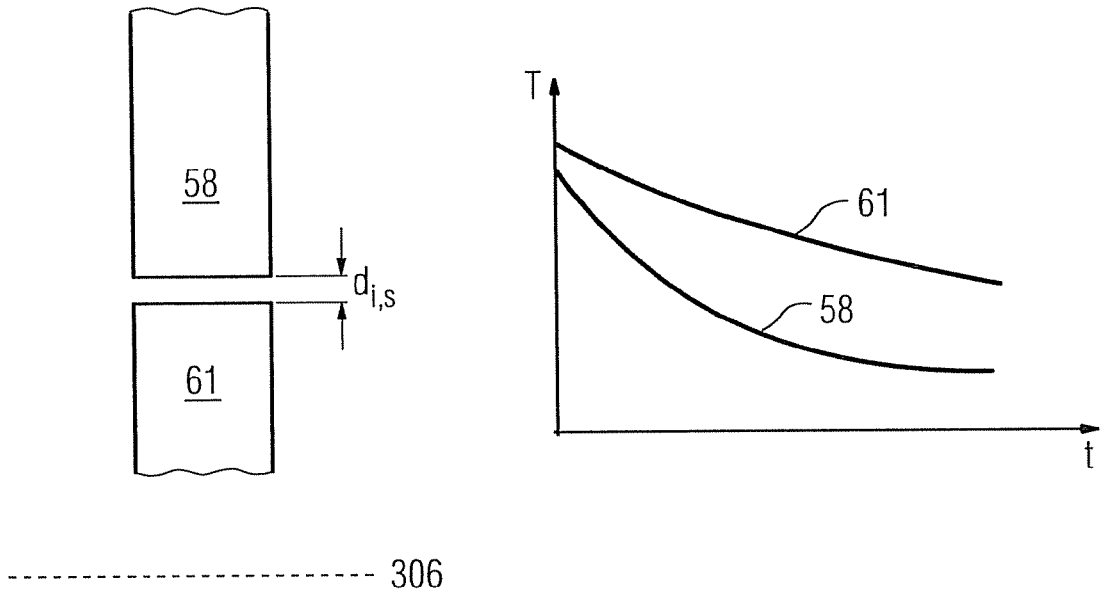
Figure 17:
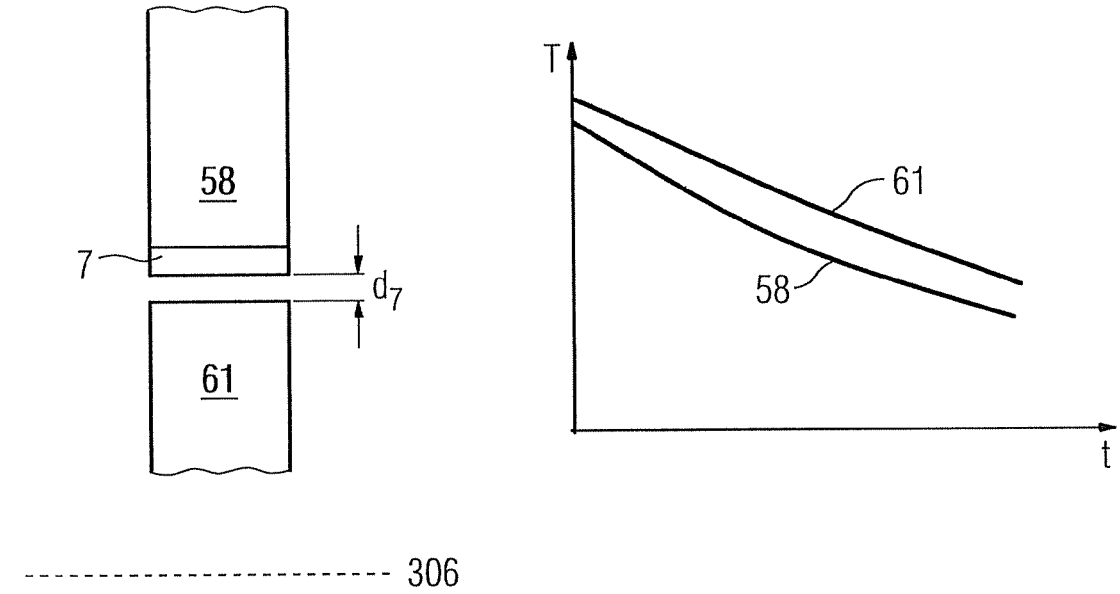

In particular the efficiency of a steam turbine 300, 303 can be increased by the controlled deformation properties effected by application of a thermal barrier coating. This is achieved, for example, by minimizing the radial gap (in the radial direction, i.e. perpendicular to the axis 306) between rotor and stator parts (housing) (FIGS. 16, 17).

It is also possible for an axial gap 378 (parallel to the axis 306) to be minimized by the controlled deformation properties of blading of the rotor and housing.

The following descriptions of the use of the thermal barrier coating 7 relate purely by way of example to components 1 of a steam turbine 300, 303.

FIG. 9 shows the effect of locally different temperatures on the axial expansion properties of a component.

Figure 9A:
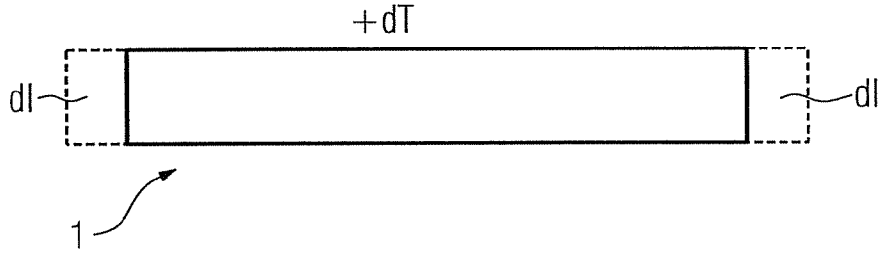

FIG. 9*a* shows a component 1 which expands (dl) as a result of a temperature rise (dT).

The thermal length expansion dl is indicated by dashed lines. Holding, bearing or fixing of the component 1 permits this expansion.

Figure 9B:
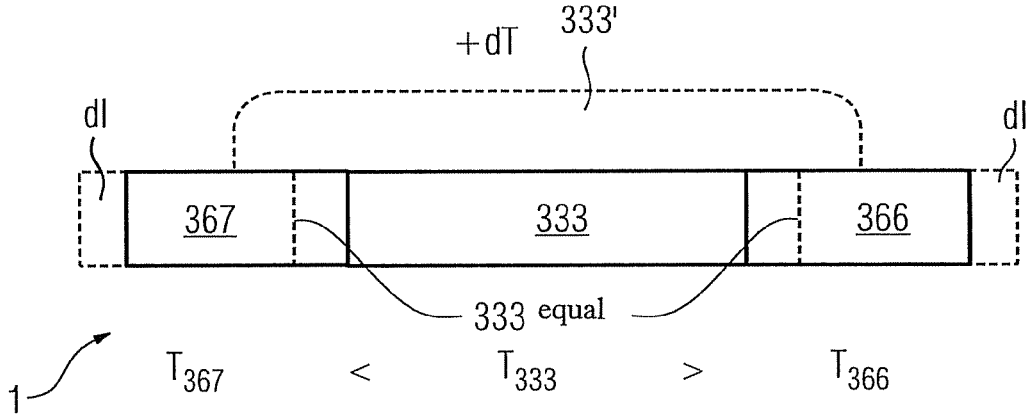

FIG. 9*b* likewise shows a component 1 which expands as a result of an increase in temperature.

However, the temperatures in different regions of the component 1 are different. For example, in a middle region, for example the inflow region 333 with the housing 335, the temperature $T_{333}$ is greater than the temperature $T_{366}$ of the adjoining blading region (housing 366) and greater than in a further, adjacent housing 367 ($T_{367}$). The dashed lines designated by the reference symbol $\mathbf{333}_{equal}$ indicate the thermal expansion of the inflow region 333 if all the regions or housings 33, 366, 367 were to undergo a uniform rise in temperature.

However, since the temperature is greater in the inflow region 333 than in the surrounding housings 366 and 367, the inflow region 333 expands to a greater extent than what is indicated by the dashed lines 333'. Since the inflow region 333 is arranged between the housing 366 and a further housing 367, the inflow region 333 cannot expand freely, leading to uneven deformation properties. The deformation properties are to be controlled and/or made more even by the application of the thermal barrier coating 7.

Figure 10:
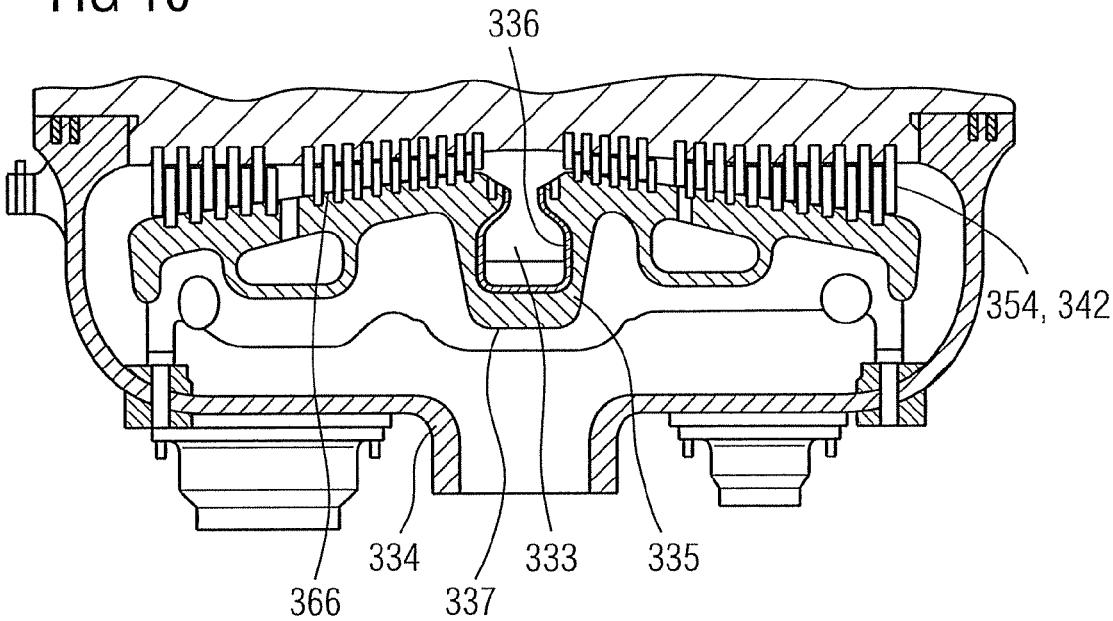
FIGS. 10, 11, 12, 13, 14, 15, 16, 17 show further use examples of a thermal barrier coating.

FIG. 10 shows an enlarged illustration of a region 333 of the steam turbine 300, 303.

In the vicinity of the inflow region 333, the steam turbine 300, 303 comprises an outer housing 334, at which temperatures for example between 250° C. and 350° C. are present, and an inner housing 335, at which temperatures of, for example 450 to 620° C., or even up to 800° C., are present, so that, for example, temperature differences of greater than 200° C. are present.

The thermal barrier coating 7 is applied to the inner side 336 of the inner housing 335 of the steam inflow region 333. By way of example, no thermal barrier coating 7 is applied to the outer side 337.

Figure 11:
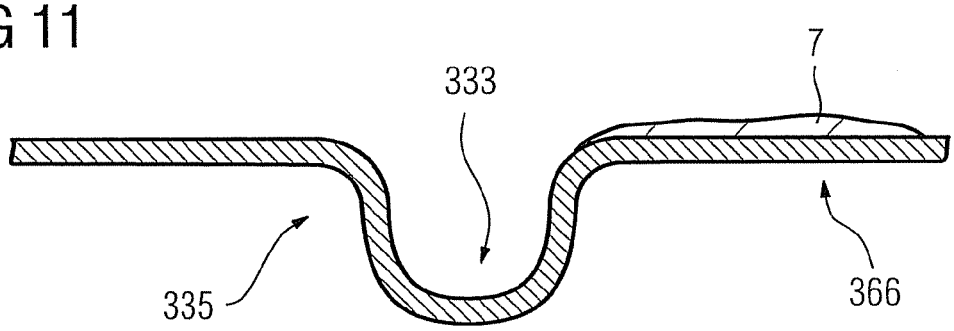

The application of a thermal barrier coating 7 reduces the introduction of heat into the inner housing 335, so that the thermal expansion properties of the housing 335 of the inflow region 333 and all the deformation properties of the housings 335, 366, 367 are influenced. As a result, the overall deformation properties of the inner housing 334 or of the outer housing 335 can be set in a controlled way and made more uniform. The setting of the deformation properties of a housing or of various housings with respect to one another (FIG. 9*b*) can be effected by varying the thickness of the thermal barrier coating 7 (FIG. 12) and/or applying different materials at different locations on the surface of the housing, cf. for example inner housing 335 in FIG. 13. It is also possible for the porosity to vary at different locations of the inner housing 335 (FIG. 14). The thermal barrier coating 7 can be applied in a locally delimited manner, for example only in the inner housing 335 in the region of the inflow region 333. It is also possible for the thermal barrier coating 7 to be locally applied only in the blading region 366 (FIG. 11).

In the context of the present application, the term different housings is to be understood as meaning housings which are adjacent to one another in the axial direction (335 adjacent to 336) and not housing parts which comprise two parts (upper half and lower half), such as for example the two-part housing of DE-C 723 476, which is split in two in the radial direction.

Figure 12:
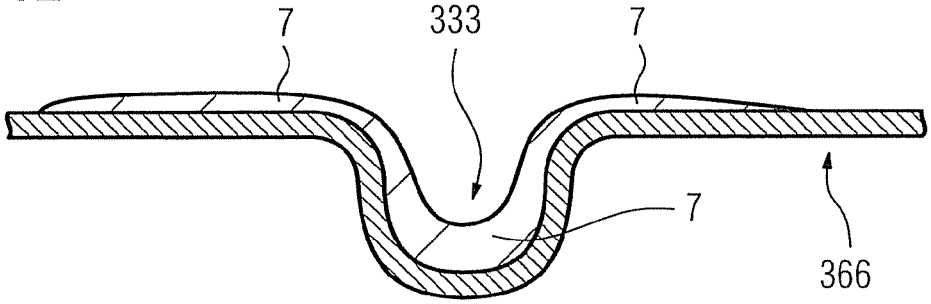

FIG. 12 shows a further exemplary embodiment of a use of a thermal barrier coating 7. Here, the thickness of the thermal barrier coating 7 in the inflow region 333 is designed to be thicker, for example at least 50% thicker, than in the housing 366 of the blading region of the steam turbine 300, 303. The thickness of the thermal barrier coating 7 is used to set the introduction of heat and therefore the thermal expansion and therefore the deformation properties of the inner housing 334, comprising the inflow region 333 and the housing 366 of the blading region, in a controlled way and to render them more uniform (over the axial length).

It is also possible for a different material to be present in the region of the inflow region 333 than in the housing 366 of the blading region.

Figure 13:
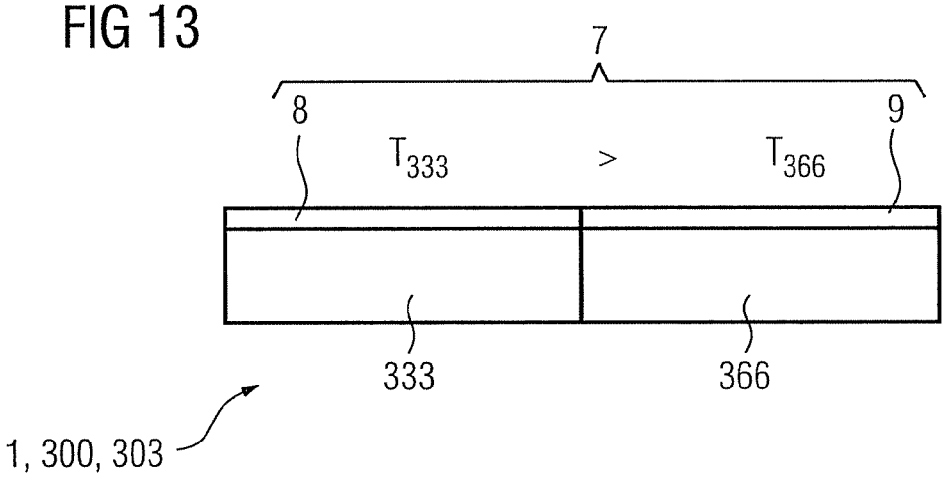
Figure 14:
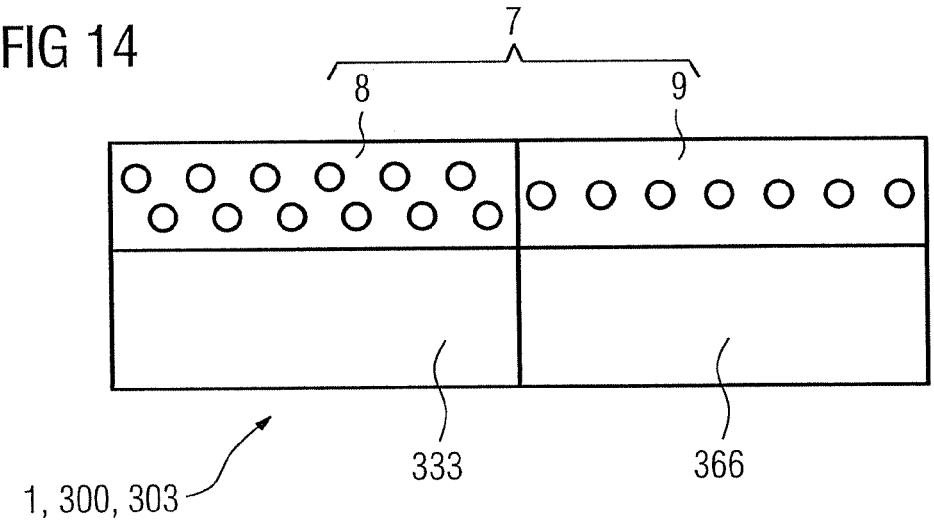

FIG. 13 shows different materials of the thermal barrier coating 7 in different housings 335, 366 of the component 1. A thermal barrier coating 7 has been applied in the regions or housings 335, 366. However, in the region of the inflow region 333 the thermal barrier coating 8 consists of a first thermal barrier coating material, whereas the material of the thermal barrier coating 9 in the housing 366 of the blading region consists of a second thermal barrier coating material. The result of using different materials for the thermal barrier coatings 8, 9 is a different thermal barrier action, thereby setting the deformation properties of the region 333 and the region of the housing 366, in particular making them more uniform. A higher thermal barrier action is set where (333) higher temperatures are present. The thickness and/or porosity of the thermal barrier coatings 8, 9 can be identical.

Of course, it is also possible for an erosion-resistant layer 13 to be arranged on the thermal barrier coatings 8, 9.

FIG. 14 shows a component 1, 300, 303 in which different porosities of from 20 to 30% are present in different housings 335, 366. For example, the inflow region 333 having the thermal barrier coating 8 has a higher porosity than the thermal barrier coating 9 of the housing of the blading region, with the result that a higher thermal barrier action is achieved in the inflow region 333 than that provided by the thermal barrier coating 9 in the housing 366 of the blading region. The thickness and material of the thermal barrier coatings 8, 9 may likewise be different. Therefore, by way of example as a result of the porosity, the thermal barrier action of a thermal barrier coating 7 is set differently, with the result that the deformation properties of different regions/housings 333, 366 of a component 1 can be adjusted.

It is also possible for the thermal barrier coating 7 described above to be applied in the pipelines (e.g. passage 46, FIG. 15; inflow region 351, FIG. 8) connected downstream of a steam generator (for example boiler) for transporting the superheated steam or other pipes and fittings which carry hot steam, such as for example bypass pipes, bypass valves or process steam lines of a power plant, in each case on the inner sides thereof.

A further advantageous application is the coating of steam-carrying components in steam generators (boilers) with the thermal barrier coating 7 on the side which is exposed to in each case the hotter medium (flue gas or superheated steam). Examples of components of this type include manifolds or sections of a continuous-flow boiler which are not intended to heat steam and/or which are to be protected from attack from hot media for other reasons.

Furthermore, the thermal barrier coating 7 on the outer side of a boiler, in particular of a continuous-flow boiler, in particular of a Benson boiler, makes it possible to achieve an insulating action which leads to a reduction in fuel consumption.

It is also possible for an erosion-resistant layer 13 to be present on the thermal barrier coatings 8, 9.

The measures corresponding to FIGS. 11, 12 and 13 are used to set the axial clearances between rotor and stator (housing), since the thermally induced expansion is adapted despite different temperatures or different coefficients of thermal expansion ($dl_{333} \approx dl_{366}$). The temperature differences are present even in steady-state turbine operation.

Figure 15:
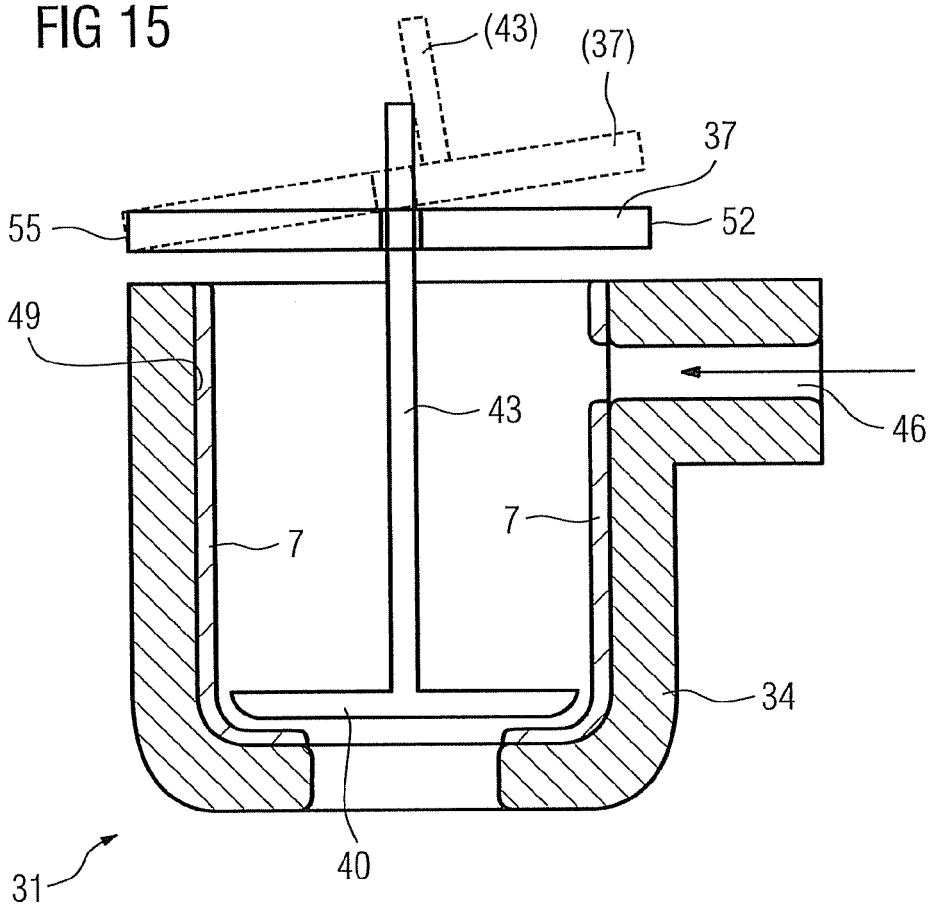

FIG. 15 shows a further application example for the use of a thermal barrier coating 7, namely a valve housing 34 of a valve 31, into which a hot steam flows through an inflow passage 46.

The inflow passage 46 mechanically weakens the valve housing 34. The valve 31 comprises, for example, a pot-shaped housing 34 and a cover or housing 37. Inside the housing part 34 there is a valve piston, comprising a valve cone 40 and a spindle 43. Component creep leads to uneven axial deformation properties of the housing 40 and the cover 37. As indicated by dashed lines, the valve housing 34 would expand to a greater extent in the axial direction in the region of the passage 46, leading to tilting of the cover 37 together with the spindle 43. Consequently, the valve cone 34 is no longer correctly seated, thereby reducing the leaktightness of the valve 31. The application of a thermal barrier coating 7 to an inner side 49 of the housing 34 makes the deformation properties more even, so that the two ends 52, 55 of the housing 34 and the cover 37 expand to equal extents.

Overall, the application of the thermal barrier coating serves to control the deformation properties and therefore to ensure the leaktightness of the valve 31.

FIG. 16 shows a stator 58, for example a housing 335, 366, 367 of a turbine 300, 303 and a rotating component 61 (rotor), in particular a turbine blade or vane 120, 130, 342, 354.

The temperature-time diagram T(t) for the stator 58 and the rotor 61 reveals that, for example when the turbine 300, 303 is being run down, the temperature T of the stator 58 drops more quickly than the temperature of the rotor 61. This causes the housing 58 to contract to a greater extent than the rotor 61, so that the housing 58 moves closer to the rotor. Therefore, a suitable distance d has to be present between the stator 58 and rotor 61 in the cold state in order to prevent the rotor 61 from scraping against the housing 58 in this operating phase.

In the case of a large rotor, the radial clearance at the temperatures of use of 600K employed in such an application is from 3.0 to 4.5 mm.

In the case of smaller steam turbines, which have temperatures of use of 500K, the radial gap amounts to 2.0 to 2.5 mm.

In both cases, it is possible, by lowering the temperature difference by 50K, to reduce this gap by 0.3 to 0.5 or up to 0.8 mm.

As a result, less steam can flow between housing 58 and turbine blade 61, so that the efficiency rises again.

In FIG. 17, a thermal barrier coating 7 has been applied to the stator (non-rotating component) 58. The thermal barrier coating 7 effects a greater thermal inertia of the stator 58 or the housing 335, which heats up to a greater extent or more quickly. The temperature-time diagram once again shows the time profile of the temperatures T of the stator 58 and the rotor 61. On account of the thermal barrier coating 7 on the stator 58, the temperature of the stator 58 does not rise as quickly and the difference between the two curves is smaller. This allows a smaller radial gap d7 between rotor 61 and stator 58 even at room temperatures, so that the efficiency of the turbine 300, 303 is correspondingly increased on account of a smaller gap being present in operation.

The thermal barrier coating 7 can also be applied to the rotor 61, i.e. for example the turbine blades and vanes 342, 354, 357, in order to achieve the same effect.

The distance-time diagram shows that there is a smaller distance d7 (d7<di<ds) at room temperature RT yet there is still no scraping between stator 58 and rotor 61. The temperature differences and associated changes in gap are caused by non-steady states (starting, load change, running down) of the steam turbine 300, 303, whereas in steady-state operation there are no problems with changes in radial distances.

Figure 18:
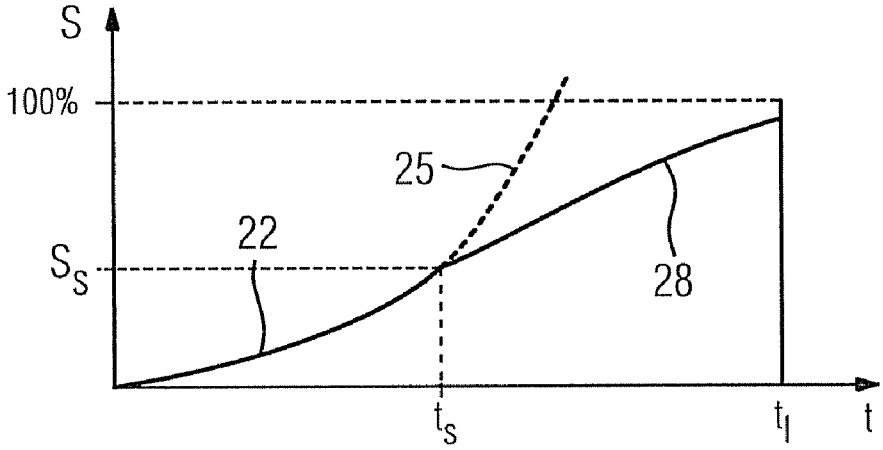
FIG. 18 shows the influence of a thermal barrier coating on the service life of a refurbished component.

FIG. 18 shows the influence of the application of a thermal barrier coating to a refurbished component.

Refurbishment means that after they have been used, components are repaired if appropriate, i.e. corrosion and oxidation products are removed from them, and any cracks are detected and repaired, for example by being filled with solder.

Each component 1 has a certain service life before it is 100% damaged. If the component 1, for example a turbine blade or vane or an inner housing 334, is inspected at a time $t_s$ and refurbished if necessary, a certain percentage of the damage has been reached. The time profile of the damage to the component 1 is denoted by reference numeral 22. After the servicing time $t_s$, the damage curve, without refurbishment, would continue as indicated by the dashed line 25. Consequently, the remaining operating time would be relatively short. The application of a thermal barrier coating 7 to the component 1 which has already undergone preliminary damage or has been subjected to microstructural change considerably lengthens the service life of the component 1. The thermal barrier coating 7 reduces the introduction of heat and the damage to components, with the result that the service life profile continues on the basis of curve 28. This profile of the curve is noticeably flatter than the curve profile 25, which means that a coated component 1 of this type can continue to be used for at least twice as long.

The service life of the component which has been inspected does not have to be extended in every situation, but rather the intention of initial or repeated application of the thermal barrier coating 7 may simply be to control and even out deformation properties of housing parts, with the result that the efficiency is increased as described above by setting the radial gaps between rotor and housing and the axial gap between rotor and housing.

Therefore, the thermal barrier coating 7 can advantageously also be applied to housing parts or components 1 which are not to be repaired.

The invention claimed is:

1. A steam turbine component assembly, comprising:

an inner housing having a surface exposed to a high temperature operating environment and an opposite surface exposed to a lower temperature operating environment where the temperature difference between the higher and lower temperature environments is at least 200° C.;

an outer housing that surrounds the inner housing; and a thermal barrier coating having a pre selected porosity, thickness or material composition applied to the higher temperature surface effective to control thermal deformation of the inner and outer housings relative to each other, wherein the thermal barrier coating is applied to a valve housing, wherein the thermal barrier coating is applied to a housing comprising a substrate comprising an iron-base, nickel-base or cobalt-base alloy, wherein the thermal barrier coating comprises zirconium oxide or titanium oxide, wherein the thermal barrier coating is applied to a housing having an intermediate protective layer arranged between the housing and the thermal barrier coating, the intermediate protective layer comprising the composition of MCrAlX where M is at least one element selected from the group consisting of nickel, cobalt or iron and X is yttrium or silicon or at least one rare earth element wherein the intermediate protective layer consists of:

11.5 wt %-20 wt %, chromium, 0.3 wt %-1.5 wt %, silicon, 0.0 wt %-1.0 wt %, aluminum, and remainder iron.

2. The steam turbine assembly as claimed in claim 1, wherein the intermediate protective layer consists of:

12.5 wt %-15 wt % chromium, 0.5 wt %-1 wt % silicon, 0.1 wt %-0.5 wt % aluminum, and remainder iron.

3. The steam turbine assembly as claimed in claim 2, wherein:

the erosion-resistant layer has a lower porosity than the thermal barrier coating, the thermal barrier coating is porous, or the thermal barrier coating has a porosity gradient, or the thermal barrier coating porosity is highest in an outer region of the thermal barrier coating, or the thermal barrier coating porosity is lowest in an outer region of the thermal barrier coating, or the thermal barrier coating thickness is locally different, or the thermal barrier coating material is locally different, or the thermal barrier coating is applied locally in surface regions of the housing or valve.

4. The steam turbine assembly as claimed in claim 1, wherein the outer housing completely surrounds the inner housing.

5. The steam turbine assembly as claimed in claim 1, wherein the higher temperature operating environment is between 450° C. and 800° C.

6. The steam turbine assembly as claimed in claim 1, wherein:

the thermal barrier coating is applied only in a steam inflow region of the steam turbine, or the thermal barrier coating is applied in an inflow region and in a housing of a blading region of the steam turbine, or the thermal barrier coating is applied only locally in a housing of a blading region.

7. The steam turbine assembly as claimed in claim 1, wherein the porosity, thickness and material composition of the thermal barrier coating are predetermined.

8. The steam turbine assembly as claimed in claim 1, wherein the thermal barrier coating controls thermal deformation of the housings between room temperature and a steam turbine operating temperature.

9. The steam turbine assembly as claimed in claim 1, wherein:

the steam turbine assembly further comprises a plurality of inner and outer housings, and the thermal barrier coating is applied to a housing of a blading region for reducing radial clearances in the steam turbine assembly.

10. The steam turbine assembly as claimed in claim 1, wherein the thermal barrier coating is applied to a housing that adjoins another housing in order to match the coated housing thermal deformation to the thermal deformation of the adjoining housing.

11. The steam turbine assembly as claimed in claim 1, wherein the thermal barrier coating is applied to a housing located in a steam inflow region of a steam turbine which adjoins a housing of a blading region, and the thermal deformation of the coated housing located in the steam inflow region is effectively controlled to match the thermal deformation of the adjoining housing of the blading region.

12. The steam turbine assembly as claimed in claim 1, wherein the thickness of the thermal barrier coating is greater in the housing of the inflow region than in the housing of the blading region.

* * * * *

UNITED STATES PATENT AND TRADEMARK OFFICE

CERTIFICATE OF CORRECTION

PATENT NO. : 7,614,849 B2
APPLICATION NO. : 10/582598
DATED : November 10, 2009
INVENTOR(S) : Schmitz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 587 days.

Signed and Sealed this

Nineteenth Day of October, 2010

David J. Kappos

David J. Kappos
*Director of the United States Patent and Trademark Office*